US008997820B2

(12) United States Patent
Giachetti

(10) Patent No.: US 8,997,820 B2
(45) Date of Patent: Apr. 7, 2015

(54) METHOD AND MACHINE FOR LABELLING BUNCHES OF CLOTHS

(71) Applicant: Morgan Tecnica S.p.A., Coccaglio (IT)

(72) Inventor: Fabrizio Giachetti, Brescia (IT)

(73) Assignee: Morgan Tecnica S.p.A., Coccaglio (IT)

( * ) Notice: Subject to any disclaimer, the term of this patent is extended or adjusted under 35 U.S.C. 154(b) by 0 days.

(21) Appl. No.: 14/190,336

(22) Filed: Feb. 26, 2014

(65) Prior Publication Data

US 2014/0190637 A1 Jul. 10, 2014

Related U.S. Application Data

(62) Division of application No. 13/577,542, filed as application No. PCT/IB2011/050446 on Feb. 2, 2011, now Pat. No. 8,702,894.

(30) Foreign Application Priority Data

Feb. 11, 2010 (IT) ..... BS2010A0024

(51) Int. Cl.

| | |
|---|---|
| ***B65H 37/04*** | (2006.01) |
| ***B65C 9/40*** | (2006.01) |
| ***B65C 5/00*** | (2006.01) |
| ***B65C 5/02*** | (2006.01) |

(52) U.S. Cl.

CPC ..... *B65C 9/40* (2013.01); *Y10T 156/1702* (2015.01); *B65C 5/00* (2013.01); *B65C 5/02* (2013.01)

(58) Field of Classification Search

CPC ..... B65C 5/00; B65C 9/40; B65C 5/02; Y10T 156/1702

USPC ..... 156/569, 570, 566, 767, 378, 350, 358, 156/285, DIG. 31, DIG. 2

See application file for complete search history.

(56) References Cited

U.S. PATENT DOCUMENTS

| | | | | |
|---|---|---|---|---|
| 4,305,338 | A * | 12/1981 | Adamson | 112/113 |
| 5,259,648 | A | 11/1993 | Gerber | |
| 5,813,772 | A | 9/1998 | Magill et al. | |
| 5,882,474 | A * | 3/1999 | Gomes et al. | 156/556 |
| 6,655,436 | B1 | 12/2003 | Venditti et al. | |
| 2006/0070704 | A1 * | 4/2006 | Sinclair et al. | 156/539 |

FOREIGN PATENT DOCUMENTS

| | | |
|---|---|---|
| DE | 4304472 A1 | 8/1994 |
| EP | 0839724 A1 | 5/1998 |

* cited by examiner

*Primary Examiner* — Jacob T Minskey
*Assistant Examiner* — Vishal I Patel
(74) *Attorney, Agent, or Firm* — Pearne & Gordon LLP

(57) ABSTRACT

The method comprises the steps of arranging a bunch of cloths stacked onto one another; taking a label (4) containing a respective identifying code of the upper cloth (30) of the bunch, laying onto the label one end (23), provided with a cavity, of a gripping element (21) and creating in the cavity a pressure lower than an ambient pressure, so that the label obstructs the cavity; laying the label onto a labeling area (3*b*) of the upper cloth, and fixing the label to the upper cloth; moving the labeling area (3*b*) of the upper cloth by shifting the gripping element (21), maintaining in the cavity a pressure lower than an ambient pressure; increasing pressure in the cavity of the gripping element until the label gets off it, so that the labeling area (3*b*) of the upper cloth (30) reaches a firm position away from the respective labeling area (3*b*) of a cloth (31) lying directly below the upper cloth, so as to enable a subsequent application of a respective label (4) onto the respective labeling area (3*b*) of the cloth (31) lying directly below.

12 Claims, 5 Drawing Sheets

1
70
71
11
20
6a
22
60
2
41
40
6
3
2
3
2
21
71
4
12
23

3b
6a
2b
6b
42
2a
30
3a
2
43
41

METHOD AND MACHINE FOR LABELLING BUNCHES OF CLOTHS

FIELD OF THE INVENTION

The present invention relates to a method for labeling bunches of cloths, in particular fabric cloths, stacked onto one another. In further detail, the invention relates to a method for labeling a bunch of cloths typically having the same shape. The present invention further relates to a labeling machine configured for implementing such a method.

DESCRIPTION OF RELATED ART

Generally speaking, items such as clothing articles, e.g. a jacket, trousers or other articles, or other products, e.g. a bag, a lining or a seat cover, are made up of a given number of cloths of fabric or other sheet like material, varying according to the model, which are typically obtained from the same fabric roll, having given characteristics, such as e.g. color and composition. The shape of each cloth is cut on the roll after spreading out the latter by means of suitable cutting devices. In order to obtain a lot of items, i.e. a given number thereof also having different size, it is necessary to identify on a length of fabric roll with a suitable length, after spreading out the roll, a plurality of fabric cloths required to manufacture all the items of such a lot. The shapes of the aforesaid fabric cloths are identified one beside the other, typically so as to minimize fabric scraps. In order to optimize the following cloth cutting operations, typically in case of a large number of items, which would require a very long roll length so as to contain all fabric cloths, more roll lengths are typically spread out one overlapping the other, so as to create a stack of roll lengths typically known as "layer" (in Italian "materasso"). Each single layer of the stack of roll lengths can derive from the same fabric roll or alternatively from different fabric rolls. The stack of roll lengths is typically subjected to the action of suitable cutting devices which simultaneously cut all stacked roll lengths making up the stack of roll lengths along shape contours. Cutting will thus produce stacks of cloths known as "bunches", each bunch being made up of fabric cloths having the same shape and stacked aligned one with the other. The cloths of a single bunch can derive from different lengths of the same roll, thus likely to have similar though not perfectly identical characteristics, since a fabric roll does not keep all of its characteristics constant in points lying at a distance one to the other; thus occurs e.g. for color, which can slightly vary due to the manufacturing process of the roll. The cloths of a single bunch can also derive from different rolls, thus differing to a larger extent, e.g. for the fabric type (material, yarn, structure, weft, color, thickness, etc.).

After the cutting step each bunch undergoes the labeling step, which consists in applying a suitable label to each fabric cloth. The label contains an identifying code providing univocally all data required for its identification, e.g. for managing handling during the following processing cycle.

The label is associated to its cloth by seaming or gluing. In both cases the labeling operation requires a large use of manpower. For instance, an operator begins by labeling the first fabric cloth of the bunch and then partly or wholly moves the fabric cloth just labeled so as to access the following cloth and label it. Indeed, for every labeling operation the operator manually "leafs through" the bunch until it is over. Typically, in order to overcome possible mistakes or oversights, the operator checks at the end of the bunch that the number of labels previously prepared for the bunches matches the label applied onto the last cloth of the bunch. In case of negative results, the operator must check again the bunch and find the mistake, i.e. for instance which cloth is not labeled or has more than one label, and correct it.

It should be pointed out that, in case of seamed labels, seaming occurs manually or by using a seaming machine for each cloth, whereas in the case of adhesive labels these are typically contained in and supplied by a device manually actuated by the operator, which device can automatically apply the aforesaid identifying code onto the labels (i.e. by increasing a progressive number).

It is further known about a labeling device typically associated to the table housing the stack of roll lengths before the cutting operations, having a labeling head which is able to shift along the surface of said stack of roll lengths and laying, before the cutting operations, onto the upper roll length of the layer, i.e. onto the first sheet of said stack of roll lengths, a corresponding label in the area designed for each fabric cloth of the first single sheet. The labeling head takes the single label by means of a gripping element to which a vacuum is applied, places the label by pressing it onto the respective cloth and releases the label by releasing the vacuum. Thus, once cut, the bunches have each a single label located on the first of its fabric cloths. Then the operator manually applies the labels onto all of the fabric cloths of each bunch typically as described before.

The Applicant has found that current labeling methods and devices for fabric cloths are characterized by huge drawbacks and can be improved under various aspects. A drawback found by the Applicant consists in the manual operations required for known methods. As a matter of fact, it should be pointed out that manual labeling operations are characterized by a high repetitiveness of the operator's movements and/or position, resulting in physical stress, e.g. for the upper limbs. Moreover, the operator typically stands in a upright and substantially fixed position for a long period of time and can further bow over the bunches of cloths to be labeled for the whole duration of the activities, and such a position involves a low degree of working comfort and ergonomics. This can negatively affect the operator's health due to the high psychophysical stress caused to the operator.

A further drawback of known methods and devices which has been found by the Applicant is the long time required for applying labels onto all the cloths of a bunch, since the operator is in charge of manually leafing through each fabric cloth and of applying a respective label. That is why the step of labeling fabric cloths often represents a "bottleneck" in the whole manufacturing and packaging cycle for an item.

Moreover, this involves another drawback, i.e. the high costs related to the cloth labeling step, due both to the long time required for carrying manual operations and to the necessary use of manpower.

A further drawback of known methods and devices which has been found by the Applicant is the low accuracy of positioning of labels onto fabric cloths, since such positioning is typically performed by the operator. Moreover, the degree of accuracy which the operator can achieve depends on the working conditions and is therefore low due to the aforesaid psychophysical stress. The inaccuracy in label positioning is even more critical in the case of labels staying on the fabric cloth after packaging the item, which labels must be positioned accurately in the seaming rims of the respective cloth, i.e. inside a well defined area. The low repeatability in label positioning on different cloths of the same bunch further adds to the low accuracy.

A further drawback of known methods and devices is the high possibility of mistakes when the operator applies the label, e.g. applying two labels onto the same cloth or not applying a label onto a cloth. Moreover, a possible mistake is hard to find in real time and forces the operator to check the whole bunch, thus adding further time and costs to the labeling operation.

The technical task underlying the present invention is to provide a method for labeling bunches of cloths and a labeling machine configured so as to implement such a method and able to automate labeling operations for bunches of cloths, which can obviate one or more of the drawbacks referred to above.

In the framework of this technical task, one of the aims of the present invention in one or more of its various aspects is to provide a labeling method and a machine for labeling bunches of cloths which can reduce health risks and/or increase the comfort of operators in charge of the step of labeling fabric cloths. For instance, the aim is to eliminate the repetitiveness of labeling operations, to reduce psychophysical stress for the operators and/or to improve ergonomics. A further possible aim of the present invention in one or more of its various aspects is to provide a method and a machine for labeling bunches of cloths which can increase the productivity, by reducing time and cost connected with the operations of labeling bunches of cloths. A further possible aim of the present invention in one or more of its various aspects is to provide a method and a machine for labeling bunches of cloths characterized by a high accuracy in positioning a label onto the cloths.

A further possible aim of the present invention in one or more of its various aspects is to provide a method and a machine for labeling bunches of cloths which are able to reduce cloth labeling mistakes and/or increase the traceability of cloths within the manufacturing cycle for an item. A further possible aim of the present invention in one or more of its various aspects is to provide a method and a machine for labeling bunches of cloths which are able to be introduced into the manufacturing cycle for an item and to be interfaced with manufacturing operations and systems lying upstream and downstream from the labeling step.

SUMMARY OF THE INVENTION

One or more of the above and other possible aims, which will be more readily apparent from the following description, are basically achieved by a method for labeling bunches of cloths and by a labeling machine configured so as to implement such a method, according to one or more of the appended claims, each of them being considered alone (without its dependent claims) or in any combination with other claims, and according to the following aspects and/or embodiments, variously combined, also together with the aforesaid claims.

In one aspect, the invention relates to a method for labeling bunches of cloths stacked onto one another, the method comprising the following steps:

a) arranging the bunch of cloths;

b) taking a label containing a respective identifying code of an upper cloth lying on top of the bunch, laying onto or beside the label one end, provided with a cavity, of a gripping element and creating in the cavity a pressure lower than an ambient pressure, so that the label obstructs the cavity;

c) laying the label onto the upper cloth on a labeling area of the upper cloth and fixing the label to the upper cloth;

d) after step c), moving the label and the labeling area of the upper cloth by shifting the gripping element, maintaining in the cavity a pressure lower than an ambient pressure;

e) after step d), increasing pressure in the cavity of the gripping element until the label gets off the gripping element, so that the labeling area of the upper cloth reaches a firm position away from the respective labeling area of a cloth lying directly below the upper cloth, so as to enable a subsequent application of a respective label onto the respective labeling area of the cloth lying directly below.

As far as the Applicant knows, it has been achieved for the first time that the label, which differently from most fabrics, is typically gastight or almost gastight (i.e. sufficiently gastight so as to implement the present invention), can be used for moving at least one length of the cloth by applying a depression (or vacuum) onto the label surface once the label is fixed (with an adhesive or otherwise) to the cloth. In particular, the Applicant has exploited for the first time the same principle (and means) used for moving the label (by applying a depression) and fixing it to the cloth also for moving the cloth.

The term "cloth" refers to a length of fabric, or other flexible sheet-like material, having a respective shape, such as for instance the various fabric cloths making up an item, which can be a clothing article (e.g. a jacket, trousers or other articles), or another item (e.g. a bag, a lining, a cover for a seat, etc.). In general, the present invention can be used for cloths made of any material if suitable to obtain a flexible cloth by cutting along the contour of a shape.

Therefore, the term "cloth" can include both a fabric obtained by weaving or knitting, or a non-woven fabric (e.g. felt), or also sheets made of leather, rubber, paper, resin or other plastic material.

In one aspect, the step of arranging a bunch further comprises the step of blocking a blocking portion of the bunch, leaving a labeling portion of the bunch free to bend, the labeling portion comprising the aforesaid respective labeling areas of the upper cloth and of the underlying cloth.

In one aspect, the step of moving the label and the labeling area of the upper cloth comprises in time sequence the steps of lifting the label and the labeling area of the upper cloth and of moving the label and the labeling area of the upper cloth away from the respective labeling area of the cloth lying directly below the upper cloth in a direction substantially parallel to a lying plane of the cloth lying directly below and facing the blocking portion of the bunch.

In one aspect, the step of moving the label and the labeling areas of the upper cloth by means of the gripping element takes place by creating and maintaining in the cavity a pressure lower than the pressure created in the step of taking the label.

In one aspect, the label is an adhesive label and the step of laying the label onto the upper cloth further comprises the step of exerting a thrust, by means of the gripping element, towards and substantially perpendicular to the lying plane of the labeling area of the upper cloth.

In one aspect, in step b) devices for moving the gripping element locate said end of the gripping element on a label supply opening of said device for supplying labels so as to take a label, and in step c) they locate said gripping element so that the label, adhering to said end, lies on the upper cloth on the respective labeling area.

In one aspect, said firm position of the labeling area of the upper cloth at the end of step e) results from a folding of the upper cloth on itself along a folding line placed in the blocking portion.

In one aspect, the method comprises, after steps a) to e), an iteration of steps b) to e) referring to the cloth lying directly below and to another cloth lying directly below the latter instead of the upper cloth and the underlying cloth, respectively.

Preferably, after performing the method according to the latter aspect, the respective labeling area of the cloth lying directly below lies, in its respective firm position, aligned and in contact with the labeling area of the upper cloth (previously labeled).

In one aspect, in step a) the bunch is obtained by simultaneously cutting a plurality of single sheets of fabric or other flexible material along the contour of a shape.

In one aspect, the invention relates to a machine for labeling a bunch of cloths stacked onto one another, the machine comprising a frame defining a bearing plane for the bunch, a device for supplying labels mounted to said frame and configured so as to supply a series of labels containing each a respective identifying code for a single cloth of the bunch, and a labeling device mounted to said frame and comprising a gripping element having an end provided with a cavity configured so as to be obstructed by a label of the aforesaid series, pneumatic devices pneumatically connected to said cavity so as to vary pressure in said cavity, and devices for moving the gripping element with respect to said bearing plane, the machine further comprising an electronic central control unit programmed so as to control said supplying device, said devices for moving the gripping element and said pneumatic devices in order to perform the aforesaid steps b) to e) on a bunch of cloths arranged at least partially on the bearing plane (typically with the labeling portion lying on said plane).

In one aspect, the aforesaid electronic central control unit is programmed for implementing one or more of the aspects and/or embodiments of the method according to the present invention. In one aspect, the machine comprises a blocking device mounted onto said frame and configured for operating at least between an open configuration in which it allows a blocking portion of the bunch to be positioned on said frame, and a blocked configuration in which it removably fixes the blocking portion of the bunch to said frame.

In one aspect, said blocking device comprises a blocking element movably associated with said frame and actuating elements acting upon said blocking element for switching it between the opening and blocking configurations.

In one aspect, said devices for moving the gripping element comprise a first actuated axis along a first direction parallel to said bearing plane and above said bearing plane, a second actuated axis along a second direction parallel to said bearing plane, above said bearing plane and perpendicular to said first direction, and a third actuated axis along a third direction perpendicular to said bearing plane, above said bearing plane.

In one aspect, said first and/or second and/or third actuated axis comprise each a respective fixed part and a respective mobile part with respect to the fixed part. Preferably, said gripping element is associated to the mobile part of said third actuated axis. Preferably, the fixed part of said first actuated axis is mounted onto said frame and the fixed part of said second actuated axis is mounted onto the mobile part of said first actuated axis. Preferably, the fixed part of said third actuated axis is mounted to the mobile part of said second actuated axis.

In one aspect, said gripping element comprises a rotating axis, actuated for instance by a rotary motor, apt to enable the rotation of said end around said third direction.

In one aspect, said pneumatic devices comprise a vacuum pump connected to said cavity of said gripping element by means of a pneumatic connection.

Further characteristics and advantages will appear better from the detailed description of some exemplary though not exclusive embodiments, among which also a preferred embodiment, of a machine for labeling bunches of cloths and a related method for labeling bunches of cloths according to the present invention.

BRIEF DESCRIPTION OF THE DRAWINGS

This description will be disclosed in the following with reference to the accompanying drawings, provided to a merely indicative and therefore non-limiting purpose, in which.

DETAILED DESCRIPTION OF PREFERRED EMBODIMENTS OF THE INVENTION

Figures 1, 1A, 1B:
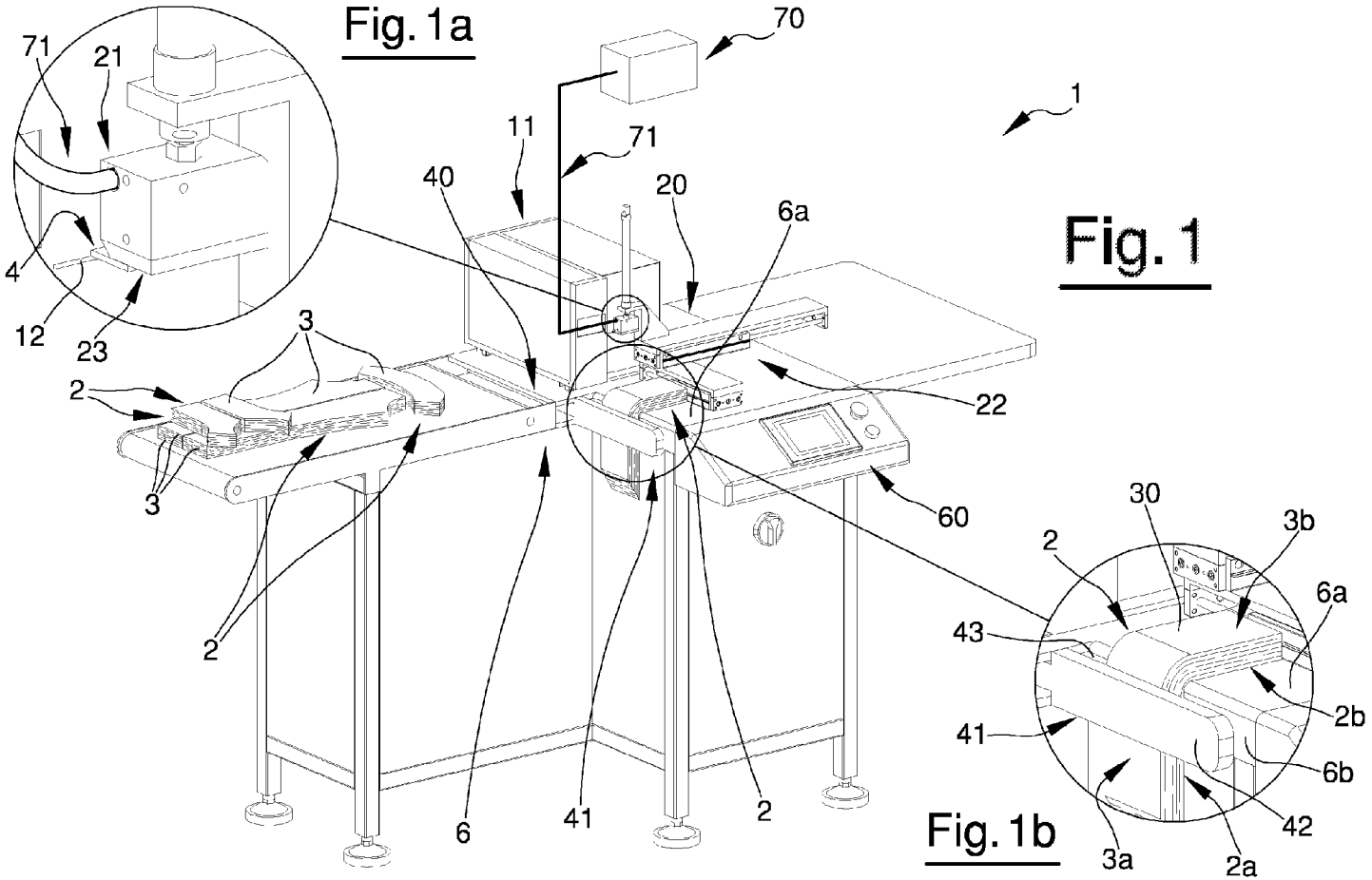
FIG. 1 is a schematic perspective view of a machine for labeling bunches of cloths according to the present invention, the machine being in a first operating step.
FIG. 1*a* shows a magnified detail of the machine of FIG. 1.
FIG. 1*b* shows another magnified detail of the machine of FIG. 1.

With reference to the accompanying figures, a machine for labeling bunches of cloths according to the present invention is globally referred to with the numeral 1. In general, the same numeral is used for identical or similar elements, possibly in their variants of embodiment.

The machine 1 is a machine for labeling bunches 2 of cloths 3 stacked onto one another (in the figures the thicknesses of the cloths and of the labels is increased to an illustrative purpose). For each bunch 2 lying on a plane (i.e. with each cloth lying on a respective lying plane, parallel to one another), the axis of vertical development (independently from its orientation in space) is the axis along which the cloths are stacked (e.g. the axis locally orthogonal to each stacked cloth), and the axis of horizontal development is the axis orthogonal to the latter. For each bunch the blocking portion 2*a* is a portion of the bunch developing along the whole extension of the bunch along the vertical axis (preferably lying on one end of the bunch with reference to the horizontal axis), and the labeling portion 2*b* is a portion of the bunch developing along the whole extension of the bunch along the vertical axis (preferably lying on the opposite end of the bunch).

Each cloth of the bunch has a respective labeling area 3*b*, destined to house a label 4, on the labeling portion 2*b* of the bunch 2.

Typically, labels used in the reference field of the present invention are flat labels, typically made of paper, having a lower adhesive face and an upper face which is possibly not adhesive. The machine 1 comprises a frame 6 defining a bearing plane 6*a* for the bunch 2. As shown by way of example in the figures, the frame 6 is made up of a supporting structure shaped so as to support the machine components, and the aforesaid bearing plane 6*a* is substantially horizontal. Preferably, as in the embodiment shown by way of example in the figures, the frame comprises vertical legs and is closed by panels, and it is preferably made of metal and/or plastic.

The machine 1 further comprises a supply device 11 for labels 4, mounted to the frame 6. This device supplies a series of labels 4, preferably from a supply opening 12, containing each one or more pieces of information preferably printed by the device. In further detail, each label contains at least one respective identifying code for a single cloth 3 of the bunch for which it is designed. Preferably, the supply device 11 further comprises a processing unit for managing label print and supply.

The machine 1 comprises a labeling device 20 mounted to the frame 6 and comprising a gripping element 21 having one end 23 provided with a cavity (not visible in the figures) configured so as to be obstructed by a label of the aforesaid series, and pneumatic devices 70 (schematically shown) connected in pneumatic communication to the cavity so as to vary the inner pressure thereof. The labeling device 20 comprises movement devices 22 for the gripping element 21 with respect to the bearing plane 6*a*. The machine 1 further comprises an electronic central control unit 60 programmed so as to control the supply device 11, the movement devices 22 and the pneumatic devices in order to implement the various steps of the present invention on a bunch 2 of cloths 3 arranged with at least the labeling portion 2*b* on the bearing plane 6*a*.

Preferably, the machine 1 further comprises a blocking device 40, shown by way of example in the figures and in particular in FIG. 1*b*, mounted onto the frame 6. This blocking device 40 can operate at least between an open configuration in which it allows a blocking portion 2*a* of the bunch to be positioned on the frame 6, and a blocked configuration in which it removably fixes the blocking portion 2*a* of the bunch to the frame.

Preferably, as in the embodiment shown by way of example in the figures, the blocking device 40 comprises a blocking element 41 mobile with respect to the frame 6, and actuating elements (not visible in the figure, e.g. one or more actuated axes) acting upon the blocking element 41 for switching it between the open and blocked configurations. By way of example, the blocking element consists of a stiff bar 42 placed beside the bearing plane 6*a*. Preferably, the bar and the frame define between them a housing compartment 43 for inserting and fixing the blocking portion 2*a* of the bunch. In further detail, when the blocking device 40 is in open configuration, the bar 42 is at a sufficient distance from the frame and the housing compartment 43 can be accessed by the blocking portion 2*a* of the bunch, whereas when the blocking device 40 is in blocked configuration, the bar 42 lies near the frame and causes the locking of the blocking portion 2*a* of the bunch between the bar and an outer surface 6*b* of the frame 6, e.g. lying adjacent to the bearing plane 6*a* and transversal (e.g. orthogonal) to the latter. Preferably, as shown by way of example in the figures, once the blocking portion 2*a* is locked, the labeling portion 2*b* of the bunch is free to lie on the bearing plane 6*a*, since the bunch is made up of flexible cloths 3 and can then be folded. Preferably, as in the embodiment shown by way of example in the figures, the movement devices 22 comprise a first actuated axis 25 along a first direction parallel to the bearing plane 6*a* and above the latter. Preferably, the movement devices 22 further comprise a second actuated axis 26 along a second direction parallel to the bearing plane 6*a*, above the latter and perpendicular to the aforesaid first direction. Preferably, the movement devices 22 further comprise a third actuated axis 27 along a third direction perpendicular to the bearing plane 6*a* and above said bearing plane.

Preferably, as shown by way of example in the figures, the first 25 and/or the second 26 and/or the third 27 actuated axis comprise each a respective fixed part 25*a*, 26*a* and 27*a* and a respective mobile part 25*b*, 26*b* and 27*b* with respect to the fixed part.

Preferably, the gripping element 21 is associated with the mobile part 27*b* of the third actuated axis 27. Preferably, the fixed part 25*a* of the first actuated axis 25 is mounted onto the frame 6 and the fixed part 26*a* of the second actuated axis 26 is mounted onto the mobile part 25*b* of the first actuated axis 25. Preferably, the fixed part 27*a* of the third actuated axis 27 is mounted to the mobile part 26*b* of the second actuated axis 26.

Preferably, the first 25 and/or the second 26 and/or the third 27 actuated axis comprise each a respective actuator moving the respective mobile part. Preferably, this actuator is an electric motor, e.g. a brushless motor or a linear motor, or a pneumatic or hydraulic actuator.

In the machine 1 shown by way of example in the figures, the first 25 and the second actuated axis 26 comprise each a respective pneumatic actuator of the sledge type, i.e. realized with a trolley slidingly engaged to a rail, and the third actuated axis 27 comprises a pneumatic piston actuator.

Preferably, the gripping element 21 comprises an axis of rotation actuated for instance by a rotary motor (not shown), which enables the rotation of the end 23 (e.g. of the whole gripping element 21) around the aforesaid third direction. This allows to orient the label taken by the supply device 21 with respect to the labeling portion 2*b* of the bunch 2.

Preferably, the gripping element 21 comprises a suction pad (not shown) placed on the end of the gripping element and having the aforesaid cavity.

Preferably, the pneumatic devices 70 comprise a vacuum pump connected to the cavity of the gripping element 21 by means of a pneumatic connection 71 and able to vary the inner pressure of the cavity within a range of pressure values lower than an ambient pressure.

The electronic central control unit 60 enables to manage the operation, programming and monitoring of the machine 1 and is interfaced to the supply device 11, the labeling device 20 and the blocking device 40.

Preferably, the machine further comprises a user interface 65 for entering data into the electronic central control unit 60 and/or displaying information on the status of the machine 1.

Preferably, as shown by way of example in the figures, the user interface 65 comprises a display 66 and a pushbutton panel 67. Preferably, the frame 6 can further comprise additional planes 80, 81 for laying the bunches. In further detail, as shown by way of example in the figures, the plane 80 enables to lay the bunches designed to be labeled by the machine, and the plane 81 receives the bunches that have already been labeled and discharged from the machine.

It should be pointed out that in the figures some details of the machine have been left out, e.g. some electric and pneumatic connections required for the operation of the machine, in order to make the figures more readily intelligible and since these connections are of known type. The operation of the machine 1 implementing the method as described above includes an initial step of preparation of the bunch of cloths having the characteristics as described above, typically obtained by simultaneously cutting a plurality of single sheets of fabric or other flexible material along a contour of a shape.

Preferably, the step of arranging the bunch 2 consists in blocking the blocking portion 2*a* of the bunch by means of the aforesaid blocking device 40, leaving the labeling portion 2*b* of the bunch 2 free to bend, wherein the labeling portion comprises the aforesaid respective labeling areas 3*b* of the upper cloth and of the underlying cloth.

Preferably, the supply device prints and supplies a label 4 containing a respective identifying code for an upper cloth 3 lying on top of the bunch.

Preferably, the movement devices locate, as shown by way of example in FIGS. 1 and 1*a*, the end 23 of the gripping element 21 on the supply opening 12 of the label supply device 11 in order to take the label 4.

The gripping element 21 of the labeling device 20 takes a label 4 as shown by way of example in FIG. 1*a*. The taking occurs by laying onto or near the label the end 23, provided with a cavity, of the gripping element 21 and creating in the cavity a pressure below an ambient pressure so that the label 4 obstructs the mouth of the cavity. Thus the label is integral with the end 23 and is moved by the gripping element 21 by means of the movement means 22.

Figures 2, 2A:
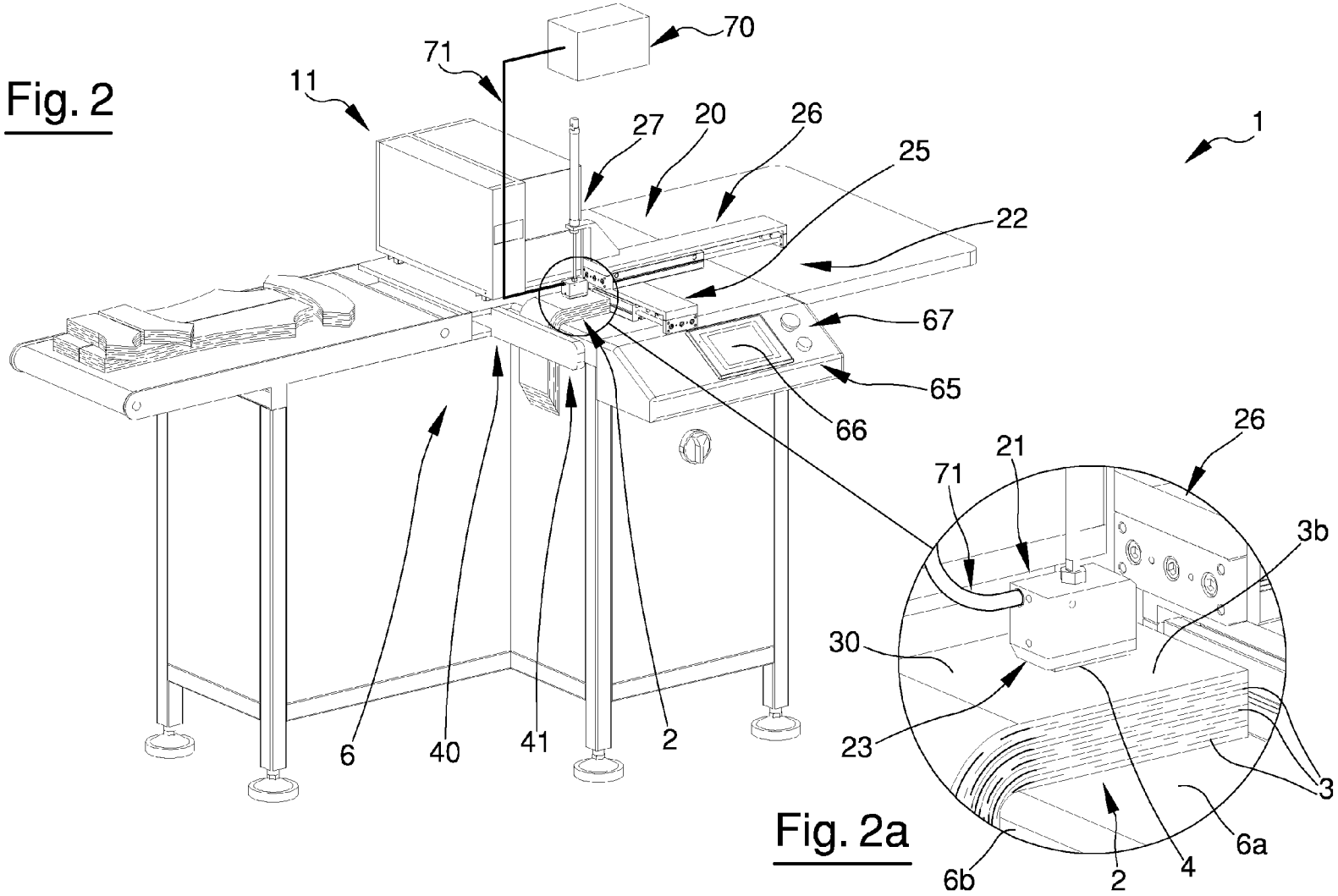
FIG. 2 is a schematic perspective view of the machine of FIG. 1, the machine being in another operating step.
FIG. 2*a* shows another magnified detail of the machine of FIG. 1.
Figures 3, 3A:
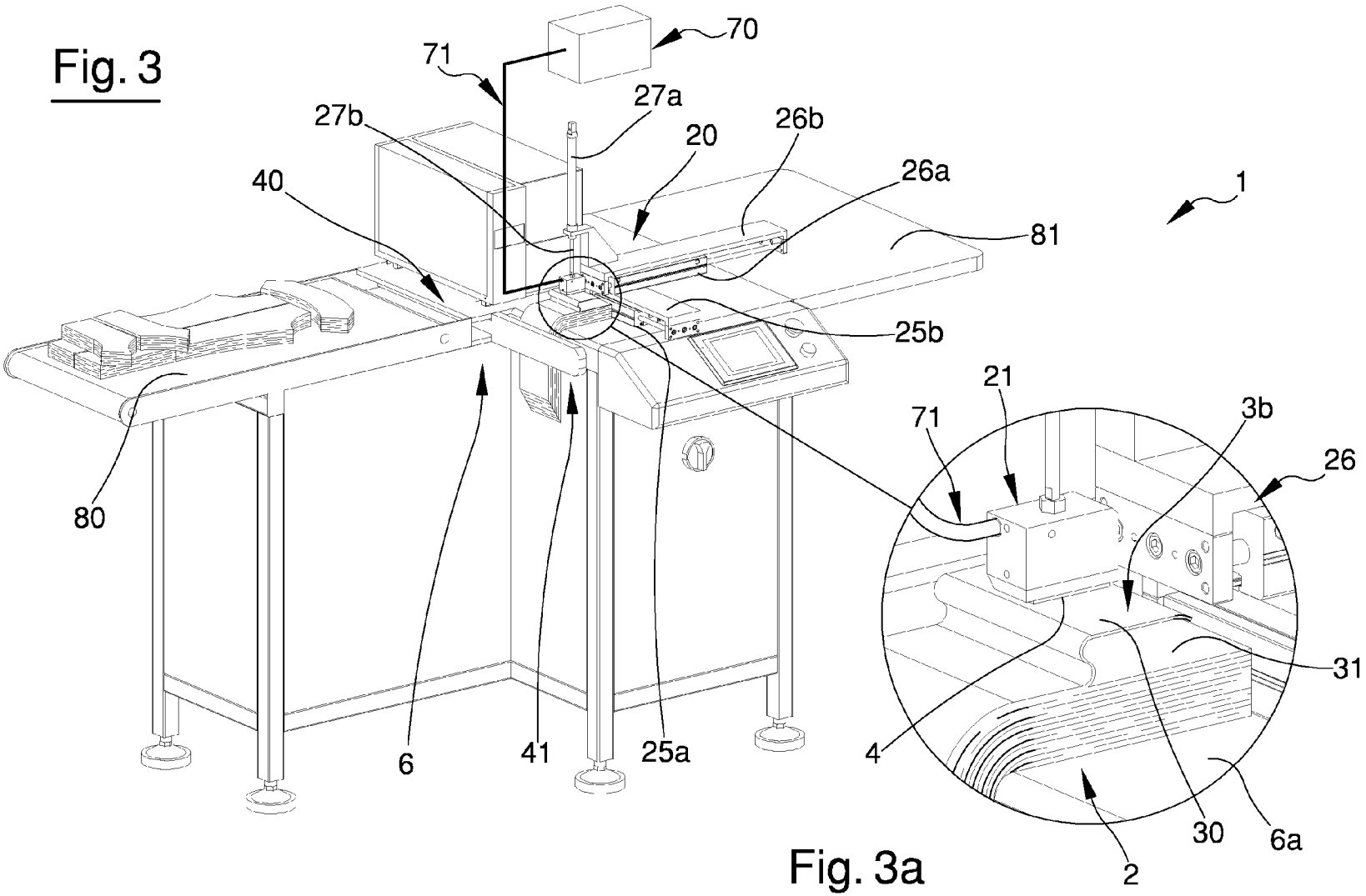
FIG. 3 is a schematic perspective view of the machine of FIG. 1, the machine being in still another operating step.
FIG. 3*a* shows another magnified detail of the machine of FIG. 1.
Figures 4, 4A:
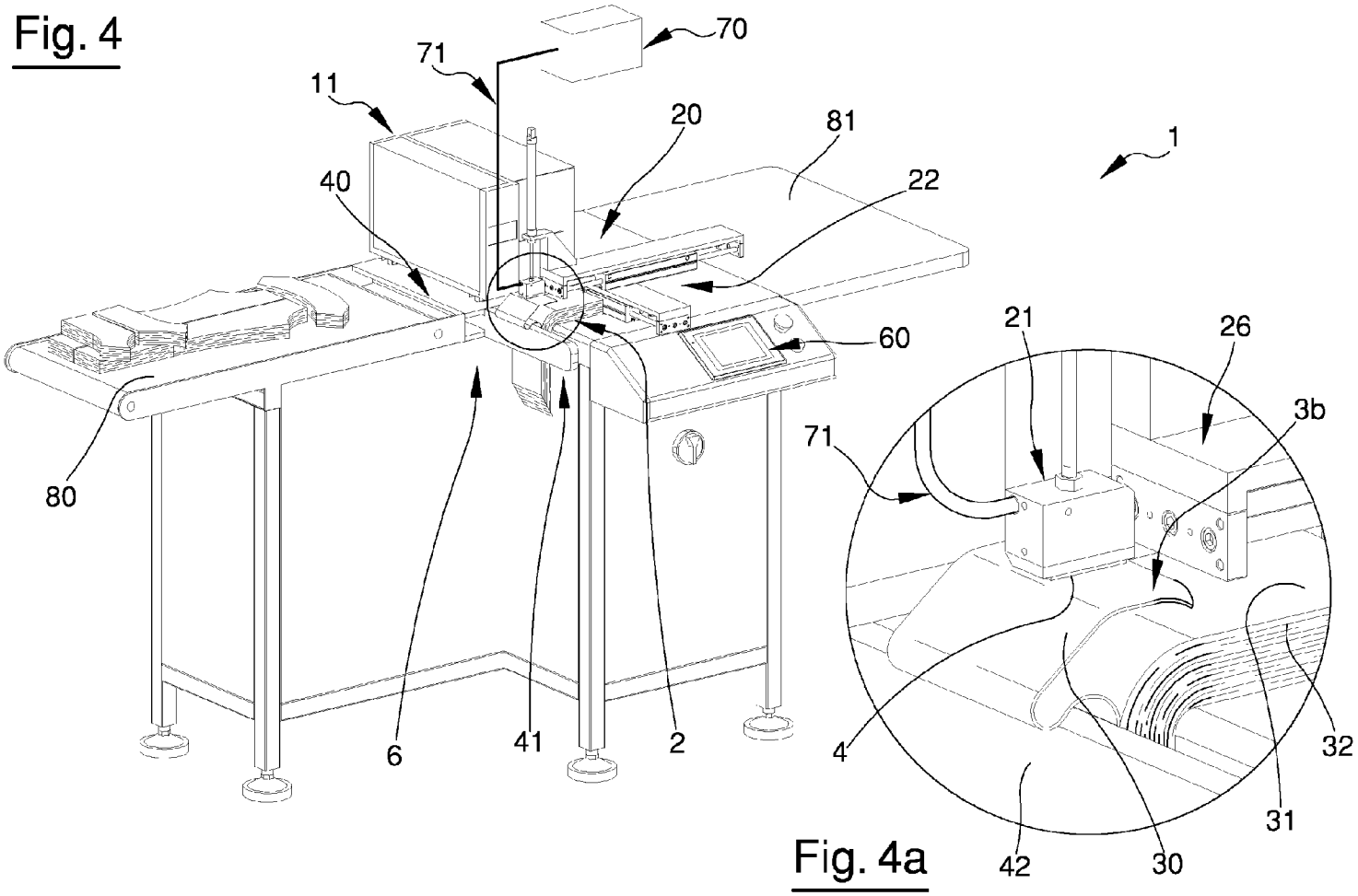
FIG. 4 is a schematic perspective view of the machine of FIG. 1, the machine being in still another operating step.
FIG. 4*a* shows another magnified detail of the machine of FIG. 1.

Subsequently, the movement means 22, as shown by way of example in FIGS. 2 and 2*a*, locate the gripping element 21 so that the label 4, adhering to the end 23, is laid onto the upper cloth 30 on a respective labeling area 3*b*, and fixed thereto. Fixing typically occurs by means of an adhesive placed on the lower face of the label or by means of a seaming stitch applied with suitable seaming devices (not shown).

Preferably, if the label is an adhesive label, when laying the label 4 onto the upper cloth 30, the gripping element 21 exerts a thrust towards the labeling area 3*b* of the upper cloth perpendicular to the lying plane of the labeling area.

Subsequently, the movement means 22, as shown by way of example in two consecutive moments in FIGS. 3 and 3*a* and 4 and 4*a*, move the label and together with the latter the labeling area 3*b* of the upper cloth 30 by moving the gripping element 21, maintaining in the cavity a pressure lower than an ambient pressure. Under these circumstances, the label itself, typically gastight or almost gastight, is used to shift at least a portion of the cloth by applying, once the label is fixed to the cloth, a vacuum onto the upper surface thereof. Basically, the same principle used to shift the label towards to labeling area 3*b* of the cloth 3 where it is fixed to the cloth is used also to move the cloth. This enables to use the same means required for taking and locating the label on the cloth to move then the same cloth to which the label has been applied. Conversely, the cloth could not be shifted if the vacuum were applied to the cloth itself, since most fabrics are not sufficiently gastight and this prevents the creation in the aforesaid cavity of the aforesaid pressure lower than an ambient pressure.

Preferably, the movement of the label 4 and of the labeling area 3*b* of the upper cloth 30 consists in time sequence in lifting both (e.g. along the aforesaid third direction) from the respective labeling area 3*b* of the cloth 31 lying directly below the upper cloth, and in moving them away in a direction parallel (e.g. the aforesaid second direction) to a lying plane of the cloth 31 lying directly below and facing the blocking portion 2*a* of the bunch 2. The result of this movement can be seen by way of example in FIGS. 4 and 4*a*.

Figures 5, 5A:
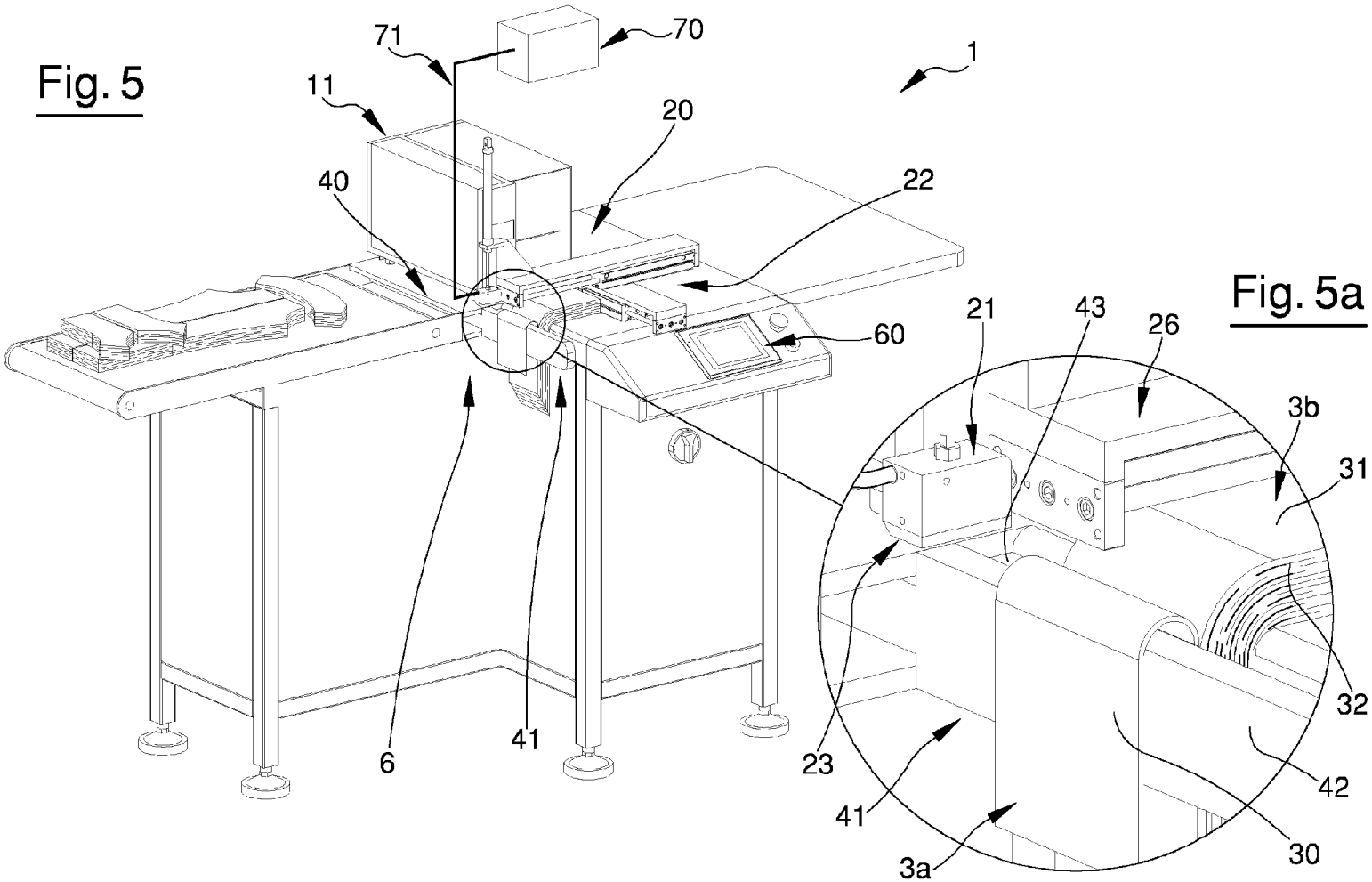
FIG. 5 is a schematic perspective view of the machine of FIG. 1, the machine being in still another operating step.
FIG. 5*a* shows another magnified detail of the machine of FIG. 1.

After the movement step the pressure in the cavity of the gripping element 21 increases until the label 4 gets off the gripping element itself, so that the labeling area 3*b* of the upper cloth 30 reaches a firm position away from the respective labeling area 3*b* of the cloth 31 lying directly below the upper cloth 30. Preferably, as shown by way of example in FIG. 5*a*, this firm position of the labeling area 3*b* of the upper cloth 30 results from a folding of the upper cloth 30 upon itself along a folding line placed in the blocking portion 2*a* (e.g. around the bar 42). In an embodiment, the label gets off by increasing pressure in the cavity up to a pressure equal to or even above ambient pressure.

This enables to apply then a respective label 4 on the respective labeling area 3*b* of the cloth 31 lying directly below.

Preferably, the steps of taking and laying the label 4 occur by creating and maintaining in the cavity of the gripping element 21 a first pressure lower than ambient pressure, whereas the step of moving the label 4 and the labeling area 3*b* of the upper cloth 30 occurs by maintaining in the cavity a second pressure lower than this first pressure (i.e. a higher vacuum).

After labeling and moving the upper cloth 30 on top of the bunch, the machine typically iterates the steps previously carried out, maintaining the blocking portion of the bunch fixed with respect to the frame. For instance, in the following iteration the labeling operations described above refer to the cloth 31 lying directly below and to another cloth 32 lying directly below the latter instead of the upper cloth 30 and the underlying cloth 31, respectively. By means of consecutive iterations, it is possible to label all the cloths of a bunch. Preferably, during each iteration of the method described, the respective labeling area 3*b* of the cloth 31 lying directly below the upper cloth 30 is, in its firm position taken after the label has got off, aligned with the labeling area of the cloth previously labeled and in contact with it. Thus, as for the embodiment of the machine 1 shown by way of example in the figures, labeled cloths can still be stacked as a bunch, for an easier handling in the following processing steps.

After the last cloth on bottom of the bunch has been labeled, the bunch is removed from the frame. This preferably occurs by switching the blocking device to the open configuration, i.e. for instance by moving the bar 42 away from the bearing plane 6*a* so as to enable the removal of the blocking portion 2*a* of the bunch 2 from the compartment 43.

Preferably, the electronic central control unit 60 interfaces the machine 1 with the manufacturing systems upstream (e.g. the aforesaid cutting devices) and downstream (e.g. cloth seaming machines) from the machine, so as to program the operation as a function of the articles to be manufactured.

Preferably, the machine 1 can further comprise monitoring devices (not shown, e.g. optical or contact sensors) connected to the electronic central control unit, which can perform checks on the bunch and/or on the single cloths and/or find possible mistakes. These monitoring devices can comprise e.g. sensors which are able to detect the position of the bunch with respect to the frame or the position of a cloth with respect to the gripping element. Moreover, they can e.g. detect the position of the label applied to the cloth and check the correct positioning thereof. Moreover, they can detect when the last cloth on bottom of the bunch has been labeled for stopping the iteration of the aforesaid steps b) to e) and possibly verify that the envisaged number of cloths (corresponding to the number of labels to be applied) matches the number of labels actually supplied.

Preferably, the machine 1 can comprise devices (not shown) for helping the separation of the upper cloth from the cloth lying directly below, e.g. a device generating a stream of air towards the labeling portion of the bunch. Thus, during the movement step of the label and of the respective upper cloth, the pressure exerted by the stream of air onto the cloth lying directly below keeps the latter pressed against the remaining underlying cloths of the bunch, preventing it from being shifted together with the upper cloth.

The invention claimed is:

1. A machine for labelling a bunch of cloths stacked onto one another, the machine comprising a frame defining a bearing plane for the bunch, a supplying device mounted to said frame and configured for supplying a series of labels containing each a respective identifying code for a single cloth of the bunch, and a labelling device mounted to said frame and comprising a gripping element having an end provided with a cavity configured for being obstructed by a label of the aforesaid series, pneumatic devices pneumatically connected to said cavity for varying pressure in said cavity, and movement devices configured for moving said gripping element with respect to said bearing plane, the machine further comprising an electronic central control unit programmed for controlling the supplying device, the movement devices and the pneumatic devices, the machine being programmed to perform the following steps:

laying the end of the gripping element onto the label containing the respective identifying code of an upper cloth on top of a bunch of cloths arranged at least partially on said bearing plane, so that the label obstructs the cavity, and creating in the cavity a pressure lower than an ambient pressure in order to take the label;

laying the label onto the upper cloth on a labelling area of the upper cloth, and fixing the label to the upper cloth;

after the preceding step, providing in the cavity a pressure lower than an ambient pressure so that the gripping element grips the label and, while the gripping element continues to grip the label, shifting the gripping element and thereby moving the label and the labelling area of the upper cloth to a different location;

after the preceding step, increasing pressure in the cavity of the gripping element until the label gets off the gripping element, so that the labelling area of the upper cloth which was moved by the gripping element reaches a firm position away from the respective labelling area of a cloth lying directly below the upper cloth, so as to enable a subsequent application of a respective label onto the respective labelling area of the cloth lying directly below.

2. The machine according to claim 1, further comprising a blocking device mounted onto the frame and comprising a blocking element and actuating elements configured for acting upon said blocking element for operating it between an open configuration in which it allows a blocking portion of the bunch to be positioned on said frame, and a blocked configuration in which it removably fixes the blocking portion of the bunch to said frame and enables a labelling portion of the bunch to lie on said bearing plane.

3. The machine according to claim 1, wherein said movement devices comprise a first actuated axis along a first direction parallel to said bearing plane and above said bearing plane, a second actuated axis along a second direction parallel to said bearing plane, above said bearing plane and perpendicular to said first direction, and a third actuated axis along a third direction perpendicular to said bearing plane and above said bearing plane, said first, second and third actuated axis comprising each a respective fixed part and a respective mobile part with respect to the fixed part, said gripping element being associated with the mobile part of said third actuated axis, said fixed part of said first actuated axis being mounted onto said frame, said fixed part of said second actuated axis being mounted onto said mobile part of said first actuated axis, and said fixed part of said third actuated axis being mounted to said mobile part of said second actuated axis.

4. The machine according to claim 2, wherein said movement devices comprise a first actuated axis along a first direction parallel to said bearing plane and above said bearing plane, a second actuated axis along a second direction parallel to said bearing plane, above said bearing plane and perpendicular to said first direction, and a third actuated axis along a third direction perpendicular to said bearing plane and above said bearing plane, said first, second and third actuated axis comprising each a respective fixed part and a respective mobile part with respect to the fixed part, said gripping element being associated with the mobile part of said third actuated axis, said fixed part of said first actuated axis being mounted onto said frame, said fixed part of said second actuated axis being mounted onto said mobile part of said first actuated axis, and said fixed part of said third actuated axis being mounted to said mobile part of said second actuated axis.

5. The machine according to claim 1, further comprising a blocking device mounted onto said frame and comprising a blocking element movably associated with said frame and configured for operating at least between an open configuration in which it allows a blocking portion of the bunch to be positioned on said frame, and a blocked configuration in which it removably fixes the blocking portion of the bunch to said frame and enables a labelling portion of the bunch to lie on said bearing plane, wherein, in the open configuration, a housing compartment is provided defining a gap between the blocking element and the frame, the gap being sufficiently wide to receive the blocking portion of the bunch.

6. The machine according to claim 5, wherein the blocking device comprises actuating elements configured for acting upon said blocking element for operating it between the open configuration and the blocked configuration.

7. The machine according to claim 5, wherein, in the blocked configuration, the blocking element lies near the frame and causes the locking of the blocking portion of the bunch between the blocking element and an outer surface of the frame.

8. The machine according to claim 7, wherein the outer surface of the frame lies adjacent to the bearing plane and transversal to the bearing plane.

9. The machine according to claim 8, wherein the outer surface of the frame lies orthogonal to the bearing plane.

10. The machine according to claim 5, wherein the blocking element is positioned beside the bearing plane.

11. The machine of claim 5, wherein the blocking portion of the bunch has a stacking direction oriented horizontally when the blocking portion is fixed to the frame.

12. The machine according to claim 5, wherein the blocking element is a stiff bar.

* * * * *